US006758470B1

(12) United States Patent
Meier et al.

(10) Patent No.: US 6,758,470 B1
(45) Date of Patent: Jul. 6, 2004

(54) CARD THICKNESS SELECTION GATE FOR A CARD FEEDER

(75) Inventors: James R. Meier, St. Paul, MN (US); Steven J. Brandt, Savage, MN (US); Brent D. Lien, Minneapolis, MN (US); Spencer L. Tapp, Richfield, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/604,214

(22) Filed: Jun. 27, 2000

(51) Int. Cl.[7] ..... B65H 3/52
(52) U.S. Cl. ..... 271/124; 271/138; 271/167
(58) Field of Search ..... 271/138, 171, 271/167, 124; 221/241

(56) References Cited

U.S. PATENT DOCUMENTS

| | | | | |
|---|---|---|---|---|
| 2,867,437 A | * | 1/1959 | Davy | |
| 2,937,019 A | * | 5/1960 | Rose | |
| 3,290,042 A | * | 12/1966 | Johnson et al. | |
| 4,032,135 A | | 6/1977 | Ruenzi | 271/116 |
| 4,443,006 A | | 4/1984 | Hasegawa | 271/10 |
| 5,082,268 A | * | 1/1992 | Santoro | 271/131 X |
| 5,299,796 A | | 4/1994 | Wooldridge | 271/9 |
| 5,350,168 A | | 9/1994 | Sheridan | 271/122 |
| 5,769,408 A | | 6/1998 | Selak et al. | 271/10.03 |
| 5,814,796 A | | 9/1998 | Benson et al. | 235/375 |
| 5,906,366 A | | 5/1999 | Chang | 271/124 |
| 5,941,522 A | | 8/1999 | Hagstrom et al. | 271/225 |
| 6,017,031 A | | 1/2000 | Oosawa et al. | 271/121 |
| 6,029,972 A | | 2/2000 | Chang | 271/124 |
| 6,193,230 B1 | * | 2/2001 | Tung-Ying | 271/124 |

* cited by examiner

*Primary Examiner*—David H. Bollinger
(74) *Attorney, Agent, or Firm*—Westman, Champlin & Kelly, P.A.

(57) ABSTRACT

A card hopper for holding a stack of identification cards that are to be printed or in other ways processed has an outlet opening on one end through which the cards are fed. The outlet opening is adjustable in size to accommodate cards of different thicknesses by using a control gate that is slidably mounted relative to the hopper and can be adjusted through the use of a cam actuator to change the opening size of the outlet opening. Manual operation is shown using both rotating and sliding cams.

21 Claims, 9 Drawing Sheets

120
122
142A
126
142
144
148
152
146
140
154
156
158
170
174
166
172
168
168A
148
134
146
192
180
178
136
CARD STACK

CARD THICKNESS SELECTION GATE FOR A CARD FEEDER

CROSS REFERENCE TO RELATED APPLICATION

This is a continuation-in-part of U.S. patent application Ser. No. 09/310,770, filed May 10, 1999 for INPUT HOPPER AND ENCODING STATION FOR CARD PRINTER, which is incorporated herein by reference.

BACKGROUND OF THE INVENTION

The present invention relates to a control gate for the outlet of a card or substrate storage hopper used with a card printer, which is adjustable to change the opening height for feeding cards of different thickness from the hopper. An actuator is used to drive a cam to adjust the position of the control gate.

Printers for ID cards and like substrates that will accept different cards or substrates have been advanced. The ability to adapt card feeders for different sizes and thicknesses of cards to reliably feed the cards into a printing station is needed. Problems can arise when feeders that are set for relatively thick cards are used for attempting to feed thin cards. At times more than one card will be fed to the printer. In addition, the ability for an operator to manually change the setting so that cards of a different thickness can be reliably fed is desired.

SUMMARY OF THE INVENTION

The present invention relates to a card hopper that has an adjustable gate for the exit or outlet opening of the hopper to permit adjusting the height of the outlet opening for cards or substrates of different thickness. The adjustable gate can be moved to insure reliable, one card at a time feeding from the card hopper. The card hopper and card feeder are used in connection with a card printer, or other processor where feeding one card at a time is essential to satisfactory operation.

The present invention includes a hopper for plastic cards or similar, fairly rigid substrates having an outlet opening covered by a gate that slides in a direction perpendicular to the plane of the card being fed, to permit adjusting the height of the opening. As shown, the gate is spring loaded in one direction toward a closed position. The gate position is changed by moving the gate against the spring load with a cam controlled by an actuator. A double acting cam or operator for positively moving the gate in both open and closed directions can be provided.

The actuator lever, as shown moves the cam so the gate is held in a desired position. An edge of the gate defines one edge of the outlet opening relative to an opposite edge of the outlet opening so the thickness of the card that will be fed is controlled. In one form of the invention, the cam is a linear ramp type cam, and in another form of the invention a rotary cam is used.

The cam may be manually operated as shown in most embodiments or a drive motor can be used as also illustrated. The motor can be controlled by a card thickness sensor or by a manual, operator selected input signal for each card thickness.

By having appropriate markings or actuator stops, the lever or other control can be used for quickly adjusting the gate so the opening matches the thickness of cards in a stack that is being fed to a printer or other processor.

DETAILED DESCRIPTION OF THE ILLUSTRATIVE EMBODIMENTS

Figure 1:
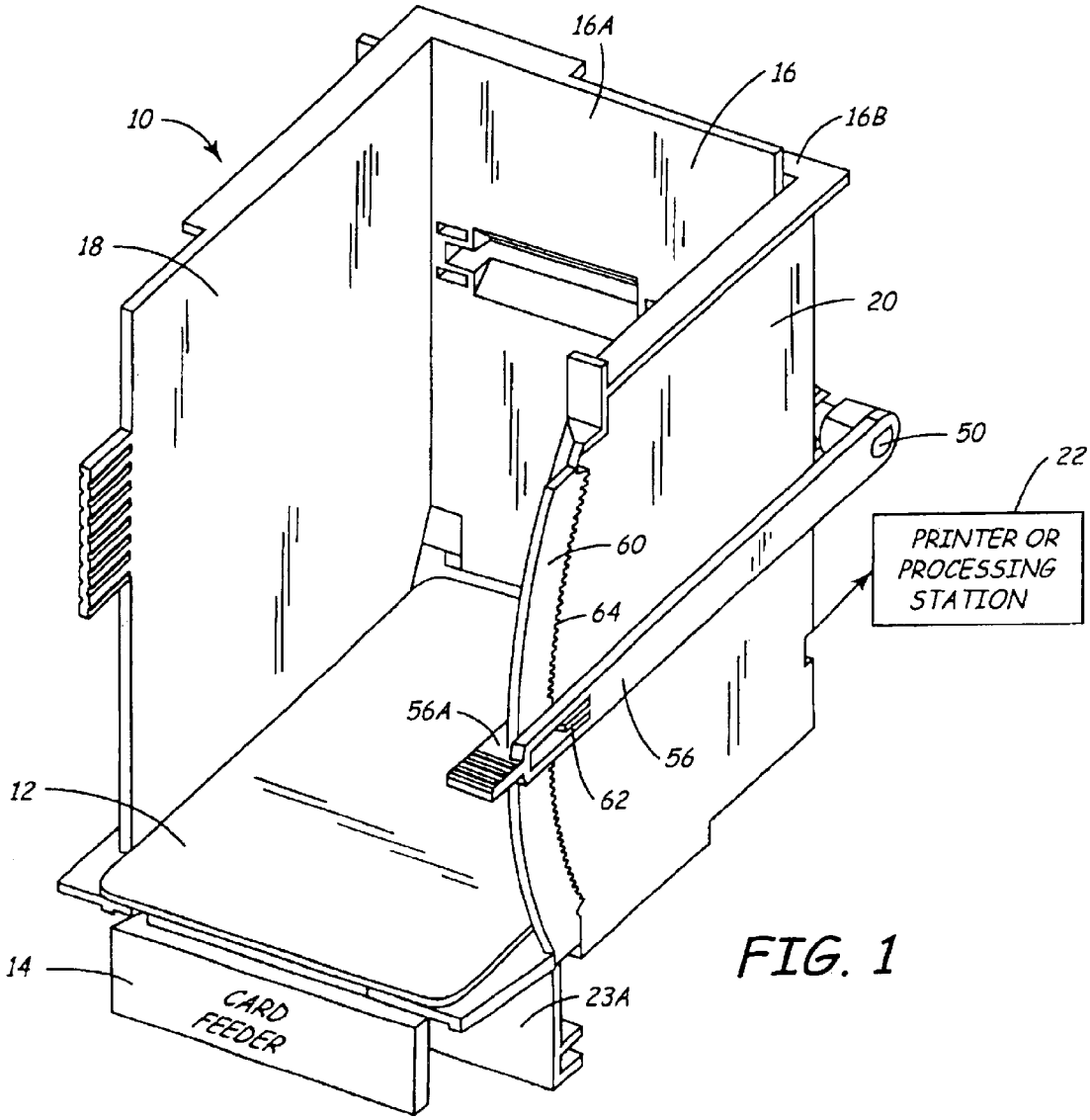
FIG. 1 is a perspective view of a card hopper viewed from the open end and having an adjustable outlet opening gate made according to the present invention.
Figure 2:
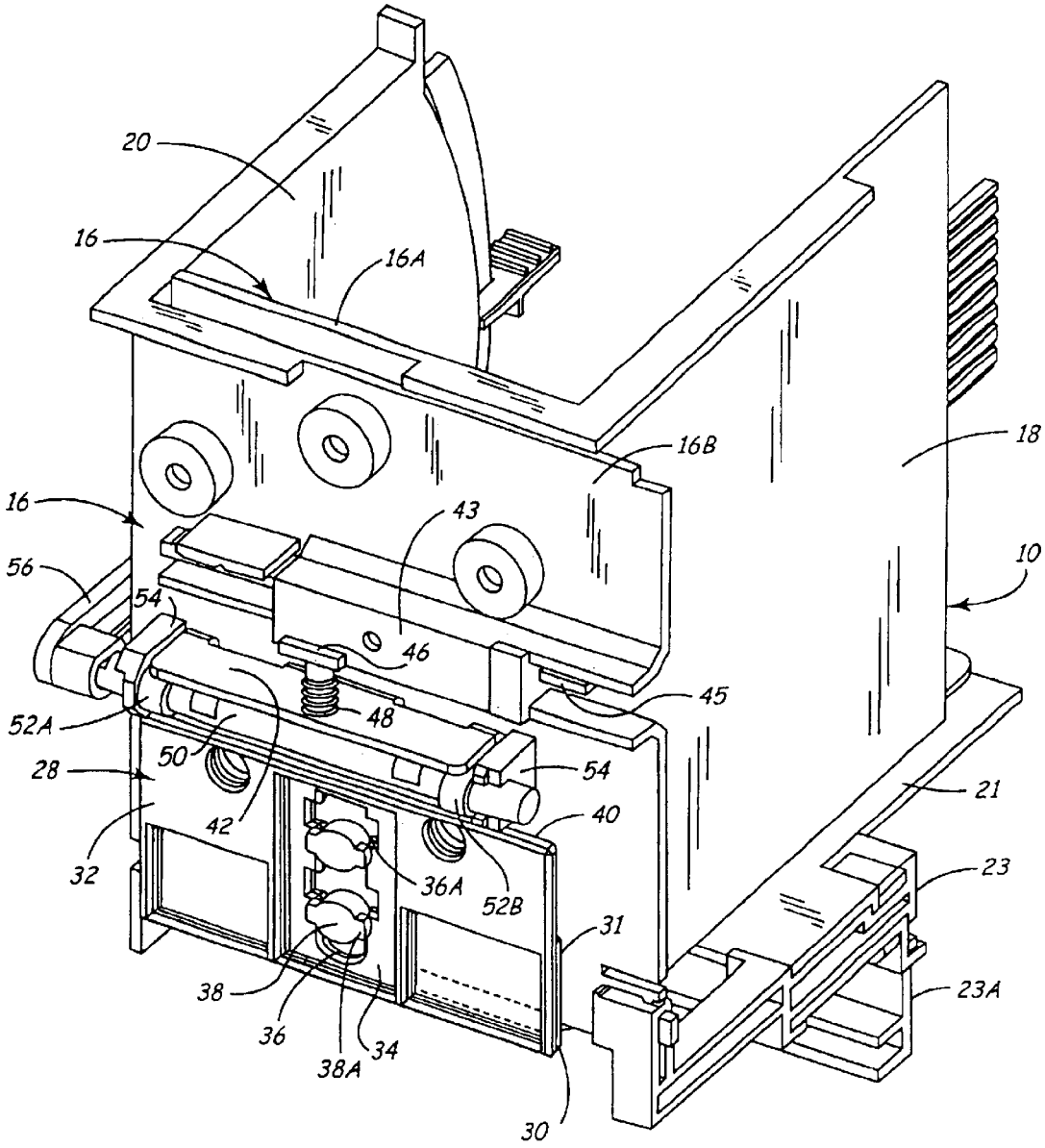
FIG. 2 is a perspective view of the outlet end of the card hopper of FIG. 1.
Figure 3:
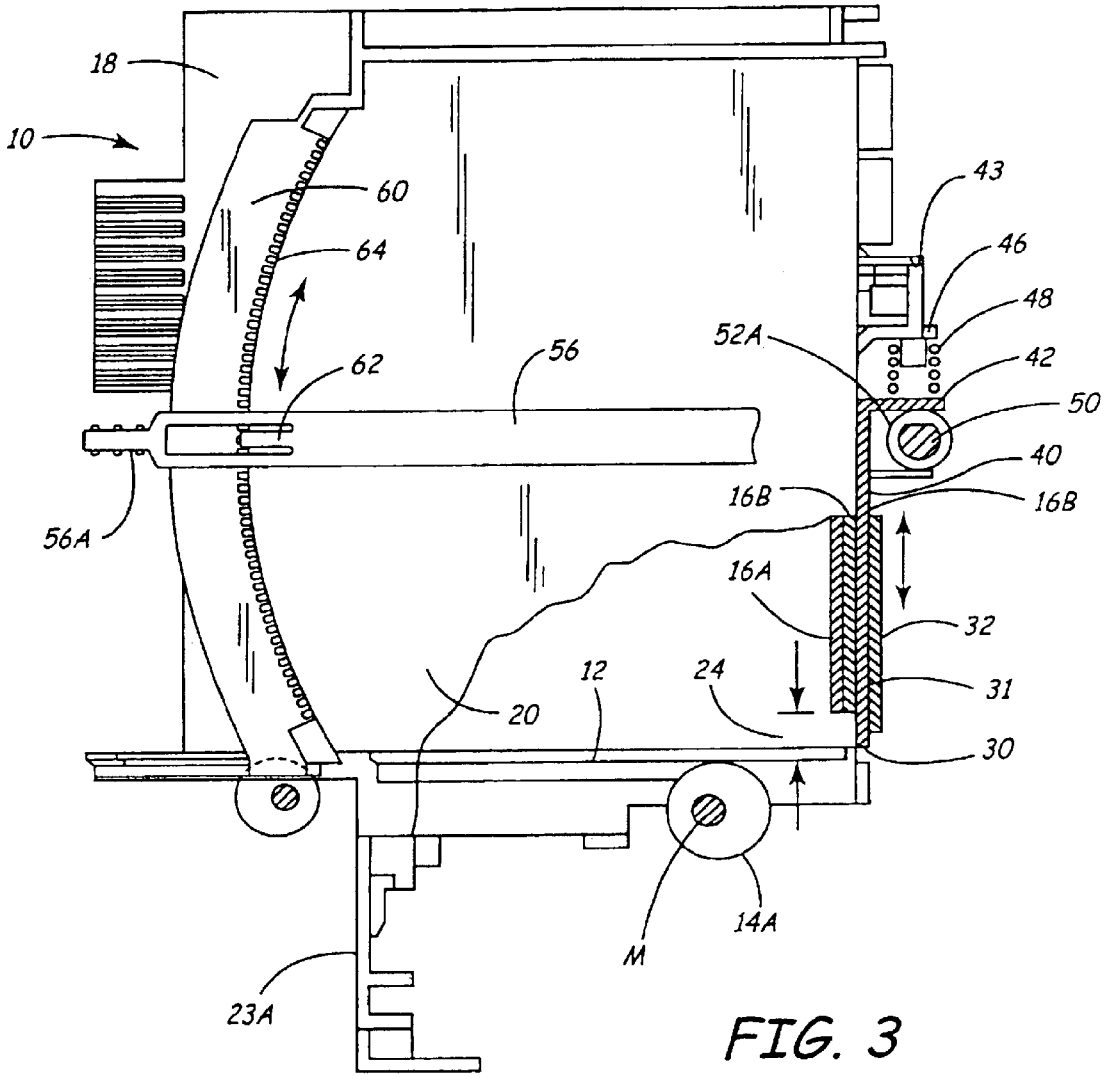
FIG. 3 is a side elevational view with parts in section and parts broken away to show the cam operator used with the card hopper of FIGS. 1 and 2.

Referring to FIG. 1, a card hopper illustrated at generally 10, is used to support a stack of cards, and one card is shown at 12 at a bottom of the hopper 10, and in position for a card feeder 14 to move the card toward an outlet wall 16 leading to a printer or processing station 22. The card feeder 14 comprises drive rollers that are well known and schematically shown in FIG. 1. The drive roller 14A is shown in FIG. 3. The hopper 10 includes laterally adjustable sidewalls 18 and 20. The front wall or outlet end wall 16 is made up of call sections 16A and 16B. The wall section 16A is attached to side wall 18 and wall section 16B is attached to side wall 20. The hopper has an open rear as shown in FIG. 1, for stacking cards in place. The side walls 18 and 20 can be adjusted laterally in a desired fashion to accept cards of different widths. The slidable wall sections can be mounted in any desired way. As shown in FIG. 2, the side wall 18 and front wall section 16A are mounted on a slider 21 that moves on a track 23 that mounts on a frame. The wall 20 is fixed to track 23 which mounts on a frame 23A, which is fixed to the frame of the printer or processing station 22.

The cards 12 are fed through an outlet opening 24 to the printer 22. The printer 22 would be any desired card printer that would receive the cards and print on them, or it could be a further card processing station, such as a lamination station. The outlet opening from the hopper is defined by a card support plane of the card feeder, or if the hopper has a bottom tray, by the bottom tray. The maximum height of the hopper outlet opening is defined by the lower edges of front wall sections 16A and 16B as shown in FIG. 3. An adjustable gate controls the actual height of the outlet opening.

It is desirable at times to have cards of different thickness fed to the same printer or processing station, and when this is done, the fixed, maximum height outlet opening from the hopper, which is shown in FIG. 3 by the double arrow 26, has to be changed in vertical height or else it is possible to have misfeeds, and double feeds of cards. The height of the outlet opening 24, is changed by utilizing an adjustable or sliding gate assembly 28 that will slide vertically along the front wall 16, and which has a lower end edge surface 30 that will change in vertical height relative to the support plane of the bottom card 12 in the hopper 10 so that the effective vertical height of the outlet opening for cards can be changed. A card 12 is shown in position in FIGS. 3 and 4 just adjacent to the opening. The card support plane is defined by the bottom surface of that card, and edge surface 30 is spaced so the card 12 will just clear the edge. The effective outlet opening height is controlled by sliding gate assembly 28.

Figure 4:
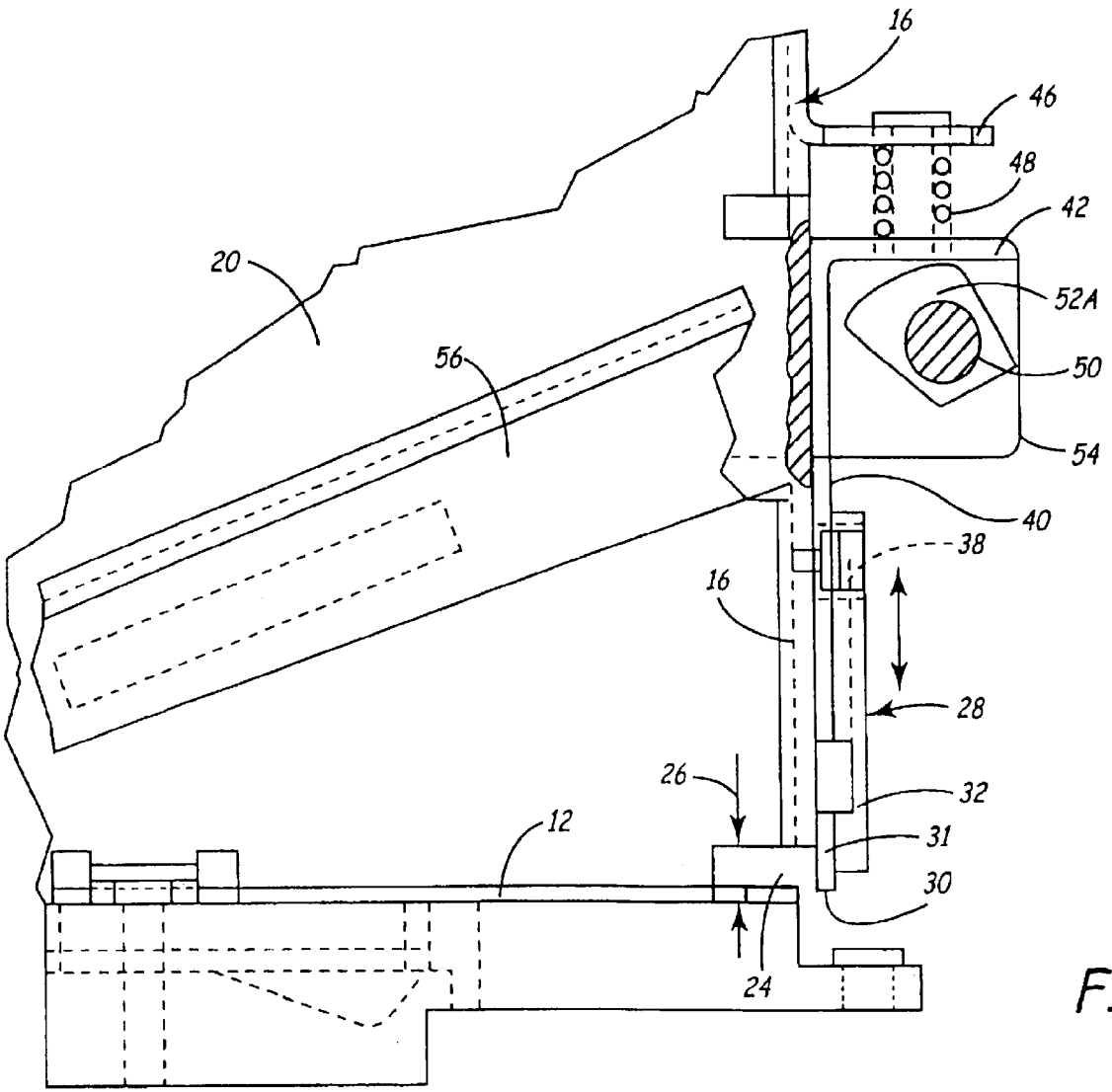
FIG. 4 is an enlarged side sectional view of the cam operator used in the card hopper of FIGS. 1–3.

Referring to FIGS. 2, 3 and 4 in particular, it can be seen that the sliding gate assembly 28 includes a slide plate 32 that carries a high friction, semi-flexible blade 31 having the end edge surface 30, and made of material such as a reinforced rubber. The blade 31 forms an adjustable throat or opening. The slide plate 32 has a center inset region 34 with a slot 36 defined therein. Suitable guides 38 are fixed to the wall section 16B, and the guides slide in the slot and hold the gate in proper position against front wall section 16B. The guides have wings 38A that fit over the sides of the slot. The slot has notches 36A which will permit removal of the slide from the guides when the notches are aligned with the wings 38A.

An actuator plate 40 mounts the side plate 32, and has an actuator flange 42 that overlies end portions of a cam shaft assembly 44. The flange 42 extends outwardly from the wall 16, as can be seen in FIGS. 2 and 3. The flange 42 of the actuator plate 40 is aligned with a lug or flange 46 that extends out from a block 43 integrally supported on front wall section 16A. A guide 45 is mounted on the front wall section 16A and the block 43 slides on the guide 45 to permit the wall section 16B to move laterally relative to wall section 16A when the width of the card hopper 10 is adjusted.

A spring 48 is positioned between the flange 46 and the actuator flange 42, as can be seen in FIG. 2 to provide a spring load that loads the flange 42 against the cam shaft assembly 44 and urges the plate 40 toward a closed position. The cam shaft assembly 44 has a shaft 50, and a pair of cams 52A and 52B that underlie the flange 42. One cam 52A is shown in FIG. 4 so that the shape of the cam can be seen.

The cam shaft assembly 44 is rotatably mounted in a pair of ears 54 that extend outwardly from and are supported on the front wall section 16B.

The cam shaft 50 extends laterally outwardly from the cam 52A, and has an actuator, as shown, a manual actuating lever 56 drivably mounted thereon. The lever 56 extends along the side of the wall 20 (see FIG. 1), toward an arcuate guide 60 which slidably fits into a slot in an end portion 56A of the lever 56. The end portion 52A has a spring latch 62. The latch 62 is made to spring load against and fit into one of the series of notches 64 that are defined in an edge of the guide 60. By manually pivoting the lever 58 up and down, the latch 62 will ratchet along the notches 64 as the end of lever 56 is adjusted vertically. The movement of the lever 56 will cause the cam shaft 50 to rotate. This will rotate the cams 52A and 52B, to act on the flange 42 and change the position of the gate assembly 28, and specifically the lower edge surface 30 of the gate assembly, relative to the lower edge of card outlet opening 24.

The series of notches or detents 64 can be made so that the gate assembly can be stopped in positions corresponding to those needed for standard card thicknesses for the card 12 in the hopper.

When the gate assembly 28 is properly adjusted, and the card feeder 14 is started, the cards 12 will be fed out just below the bottom 30 of the semi-flexible blade 31 that is carried by the sliding block 32, so that one card at a time will be fed.

The rotational adjustment of the cam shaft 50, and the cams 52A and 52B can be done manually, each time a stack of different size cards is placed into the hopper 10.

The outer end of the manual adjustment lever is accessible to an operator of the printer, and is easily changed at the time that the card stack is inserted into the hopper.

Figure 5:
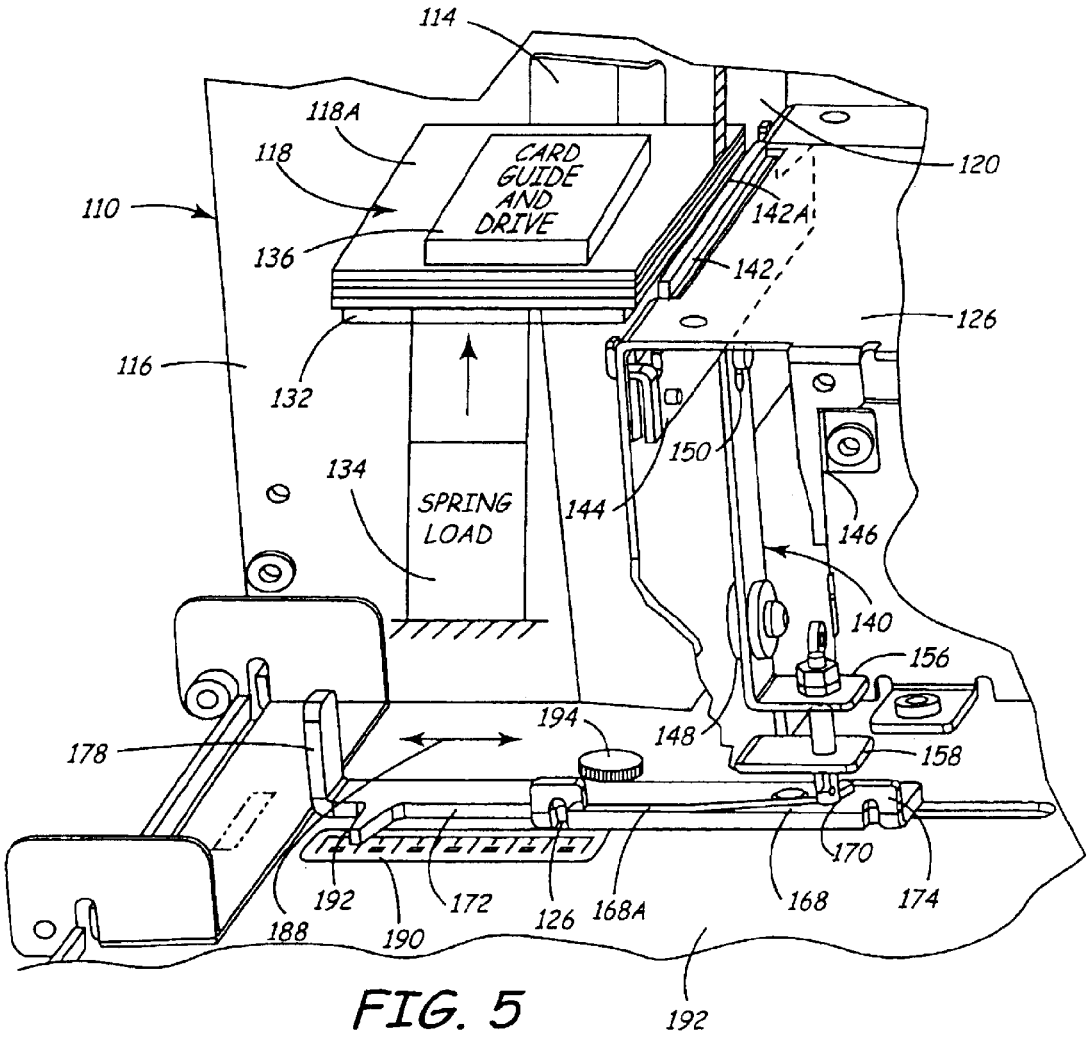
FIG. 5 is a perspective view of a second form of the invention shown in connection with a modified top feed card hopper.
Figure 6:
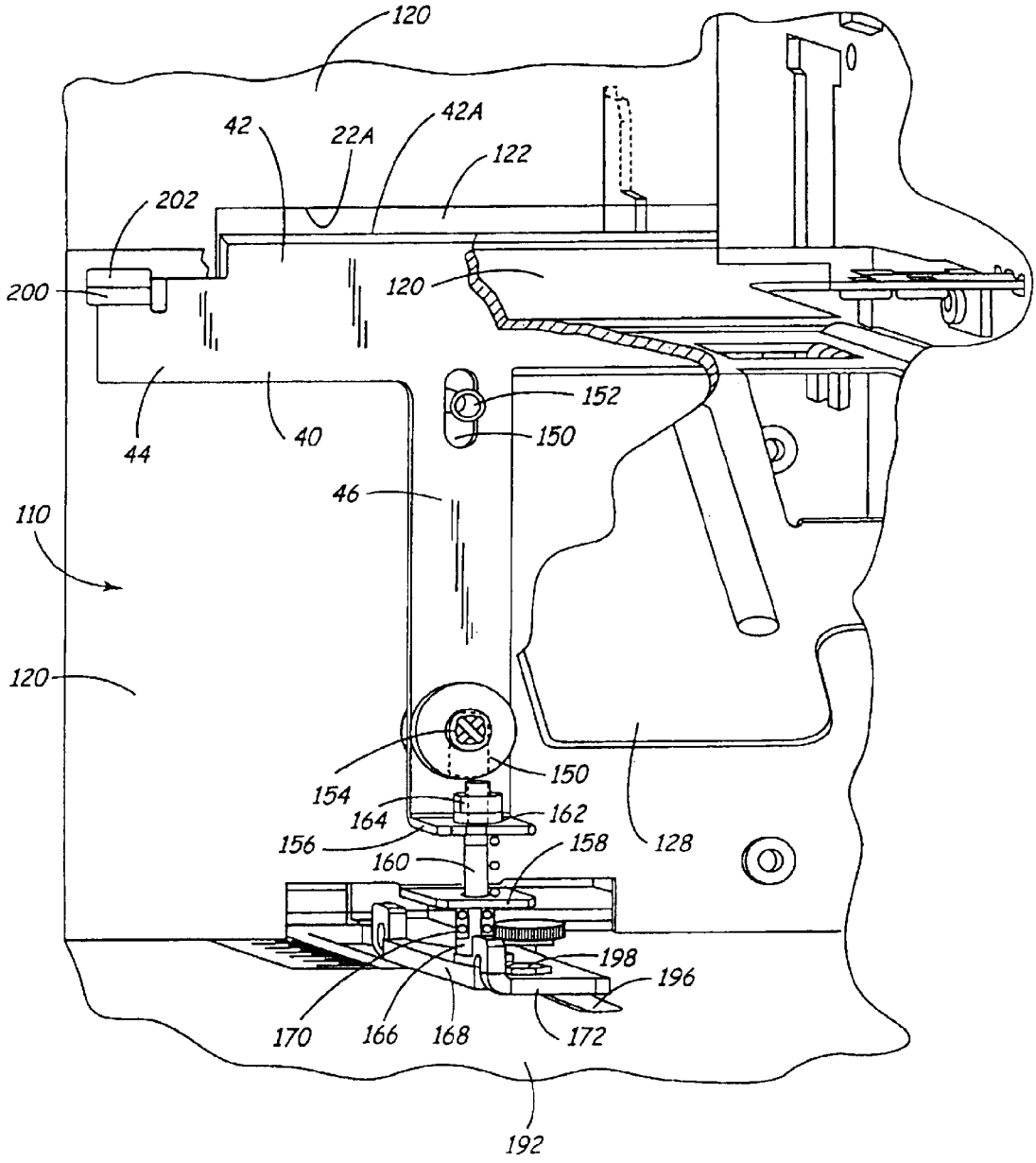
FIG. 6 is a front perspective view of the device shown in FIG. 5.
Figure 7:
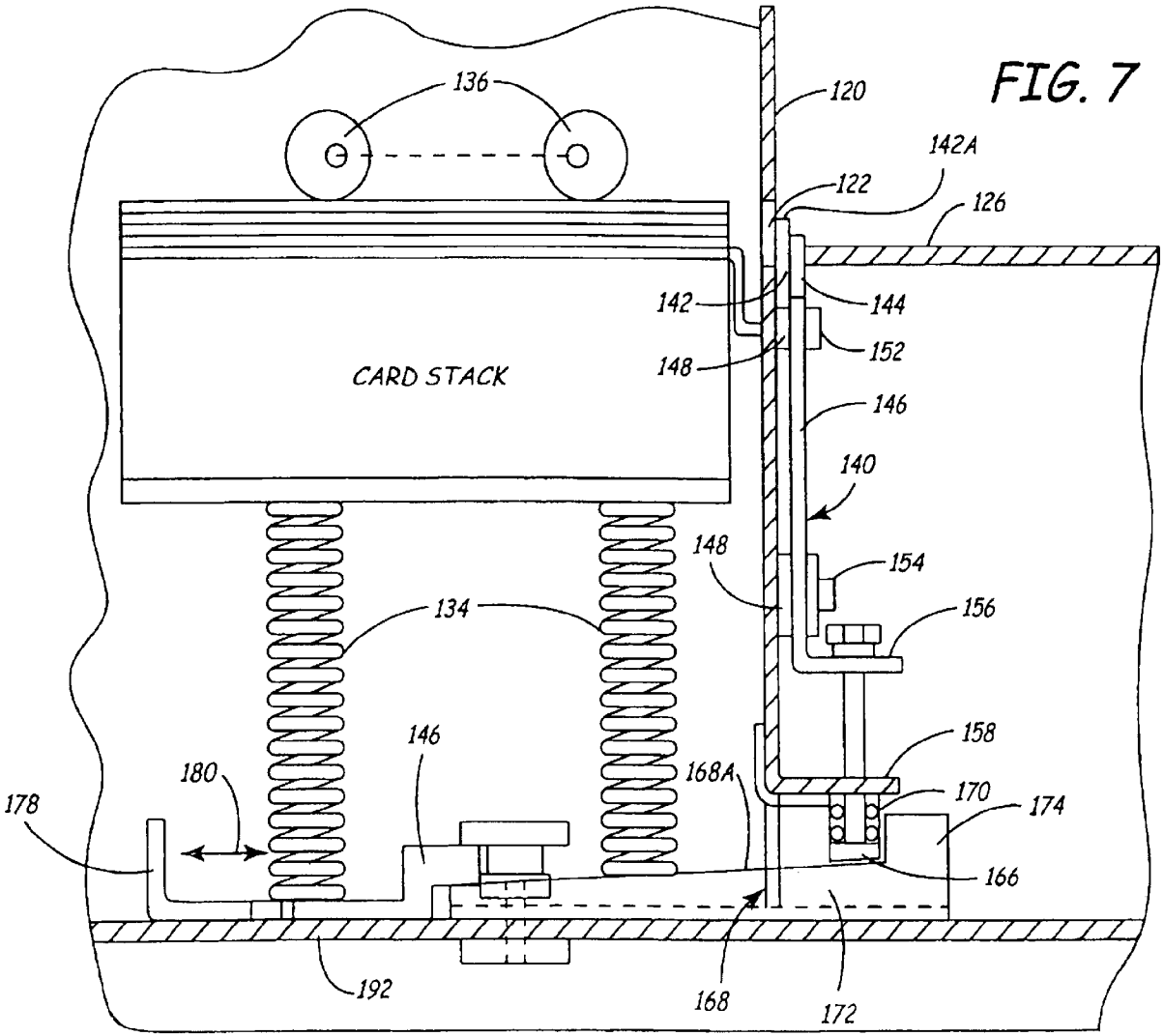
FIG. 7 is a schematic fragmentary side elevational view of the device in FIG. 5.

FIGS. 5, 6 and 7 show another aspect of the present invention including a sliding cam for adjusting an outlet opening of a card hopper, and in particular it relates to an aspect of the invention wherein the card stack is spring loaded in an upward direction and the top card of the stack is fed through a hopper outlet opening.

In FIGS. 5 and 6, a card hopper is indicated generally at 110 and while the hopper is shown only fragmentarily, it has an adjustable sidewall 114 that moves inside a main frame wall 116. Side wall 114 will bear against and guide a card stack 118 of individual cards. The hopper 110 has a front or card outlet wall 120 that is shown only fragmentarily in FIG. 4, but which can be seen in FIGS. 6 and 7. The outlet wall 120 has a card outlet opening 122 at a location that aligns with an output card support table or plate 126 which is to the exterior of the hopper. Cards coming through the opening 122 will be deposited on the table or support wall 126 and transported to a printer or similar processing station. The support wall 126 is generally horizontal, and it joins an inclined wall 128 (FIG. 6) along which cards can slide to a printer or processing station.

The card stack 118 is supported on a suitable support plate that is shown at 132, and springs 134 urge the card stack upwardly against a card guide and drive 136 which comprises a drive roller and an idler roller shown schematically in FIG. 7. The rollers for the drive establish a support plane. The card guide and drive assembly will maintain the upper card 118A at a desired level relative to the upper edge 122A (see FIGS. 6 and 7) of the card outlet opening 122. In other words, the upper surface of the upper card will always be held aligned closely with the edge 122A so that it can be driven out through the opening 122 without striking that upper edge 122A.

In this form of the invention, in order to control the vertical height of the opening 122, that is, the distance between the upper edge 122A and the lower edge of the opening, a slider control gate assembly 140 is provided, and it includes slider plate 144 that carries a flexible tongue or blade portion 142 that has an upper edge 142A. The slider plate 144 and flexible blade portion 142 are of a size to overlie or align with the opening 122. The slider plate 144 has a support tongue 146 that is integral with the slider plate 144 and extends downwardly parallel to the hopper wall 120. The tongue 146 and the slider plate 144 can be spaced from the wall 120 a desired amount, with suitable spacers 148 shown in FIG. 5. Additionally, the tongue 146 has a pair of slots 150 that extend in vertical direction, and which receive suitable guides 152 and 154, to guide the path of movement of the slider 144 in a vertical direction along wall 120. The tongue 146 has an actuator flange 156 that extends at right angles to the plane of the tongue 146, and the actuator flange 156 overlies a guide flange 158 that is integral with and bent out of the plane of the wall 120. The guide flange 158 has an opening for slidably receiving a vertical cam follower post 160. The cam follower post 160 is threaded into a nut 162 fixed on the upper side of the actuator flange 156 and is locked in place with a lock nut 164. The lower end of the cam follower 160 has a head 166 that engages an upper surface of a wedge or sliding cam 168. The cam follower head 166 is urged down against the cam with a suitable spring 170 that is shown only schematically.

The wedge 168, as shown, is formed from a sliding cam plate 172 by bending up one side portion of the cam plate 172 and providing an upper cam surface 168A that inclines from a high point where the head 166 is illustrated, and which is adjacent an end stop 174, to a low point adjacent a stop 176. The sliding cam plate 172 has a manual tab 178 that can be operated by the operator of the printer and moved in directions as indicated by the arrow 180. Additionally, an indicator plate 190 is provided on the base wall 192 of the printer frame. A pointer 192 is used for indicating the position of the cam 168 and correlating it to the position of the upper edge 142A of the tongue 142 of the slider blade 144.

A thumb screw lock 194 is threaded into the base wall 192, and has a flange that overlies one side of the sliding cam plate 172, and when tightened down will hold the sliding cam plate 172 in its position. As can be seen in FIG. 6, the base wall 192 can have a slot 196 that receives guides that will guide that cam plate 172 in place. The upper end of one guide is shown at 198 in FIG. 6.

The slider plate 144 has tabs 200 that are bent to extend through openings 202 in the wall 120, for guiding the slide plate in its travel toward and away from the outlet opening upper edge 122A.

The upper edge 142A of the flexible blade 142 is shown in their most upright position with the vertical height of opening 122 being at a minimum. By moving the sliding cam plate 172 inwardly, the cam or wedge 168 will be moved so that the height of the surface 168A is reduced, permitting the cam follower 168 to move downwardly, and spring 170 will urge the cam follower 166, flange 156, and the slider assembly 140, including the slider plate 144 and tongue 142, downwardly so that the upper edge 142A of the flexible blade moves away from the edge 122A to increase the opening height of the card output opening 122. This height dimension is the dimension of the card thickness.

The thumb screw 194 can then be tightened down to hold the plate 144 in its desired position. The indicator 190 has indicia on it to indicate the appropriate opening.

The actuator tab 178 is accessible from the exterior of the card hopper, and in this way the printer can be used for stacks of different sized cards with a relatively quick manual adjustment for determining the size of the output opening.

Both forms of the invention just described utilize cam operators. By moving the cams to desired positions, the outlet opening for the card hopper can be changed to correspond to the thickness of cards in a stack being processed. The actuators are shown as manual actuators.

It is of course apparent that the cam 168 for example, can be formed into a series of known height steps, so that the cam follower 166 would move in a step progression, with each step representing the proper position for a predetermined thickness of cards.

Figure 8:
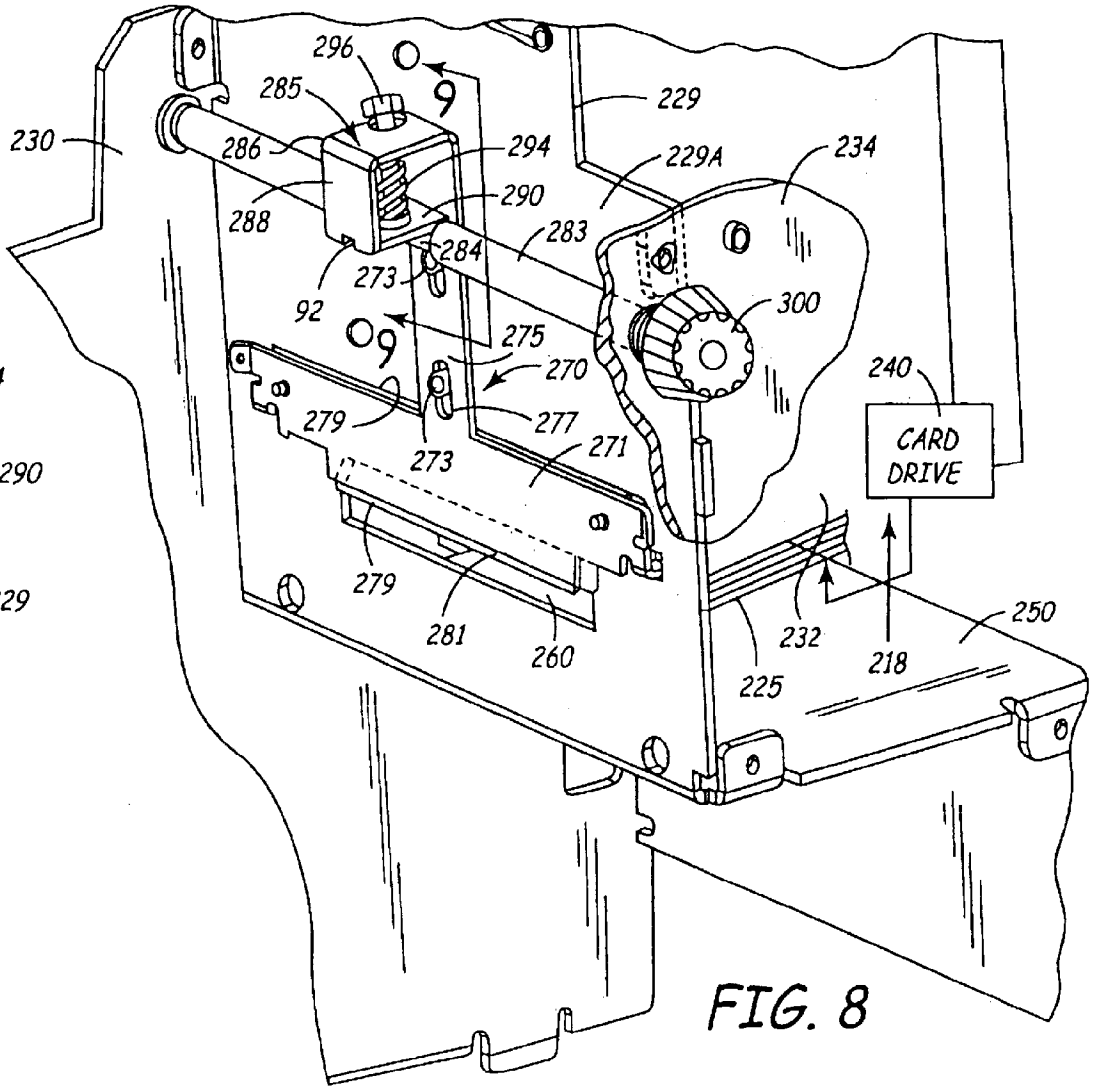
FIG. 8 is a perspective view of an outlet opening control gate for a card hopper made according to a further embodiment of the invention.
Figure 9:
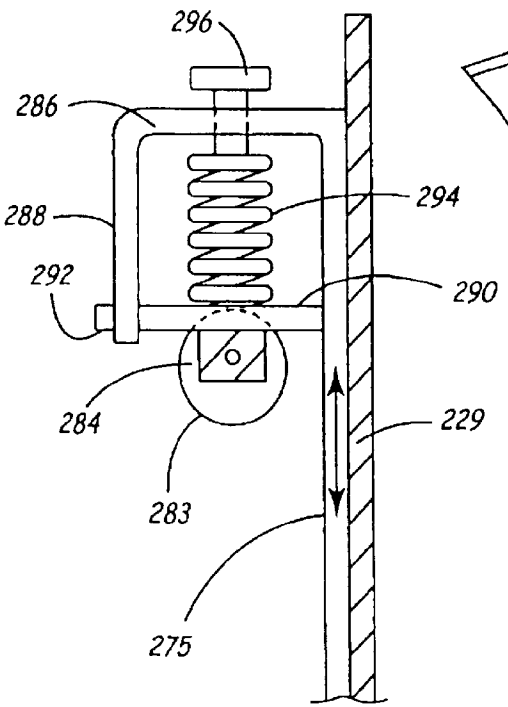
FIG. 9 is a sectional view taken along line 9—9 in FIG. 8.

FIGS. 8 and 9 show a further form of the invention, using a control gate on a hopper that has a laterally adjustable side wall. The hopper shown generally at 218 has a side wall 232 defining one side of the hopper. Suitable card drive rollers, (not shown) are driven by the card drive represented at 240. The bottom card in the stack 225 will then be moved out of the card hopper 218, as will be explained. The card hopper 218 has a stationary vertical end wall 229, and a side wall 230. In this form of the invention, a laterally adjustable guide wall (not shown) is adjustable relative to the wall 230 to permit the hopper 218 to handle cards of different widths. Any type of hopper can be used.

Cards 225 that are in the hopper 218 will rest on the card drive 240, that is shown schematically. The card drive 240 will drive one of the cards at a time from the stack 225 out through an outlet opening 260. The opening 260 is defined in the wall 229, which is the outlet wall of the hopper 218.

The outlet opening 260 is controlled as to size (vertical height), so that only an individual card from stack 225 will be fed. The thickness of the cards, which is the dimension perpendicular to the plane of the cards, may vary, and the adjustment device shown generally at 270 in FIG. 8, is utilized.

The opening 260 has adequate width and is large enough for the passage of a single card of the largest size used in a printer.

A gate 271 is slidably mounted on a pair of support pegs or posts 273, 273, affixed to the wall 229. The gate 271 has a support tongue or strap 275 that has slots 277 that slidably fit onto the posts 273. Suitable washers and fittings can be utilized for holding the strap or tongue 275 in position, so that it will slide up and down the posts 273.

The main wider portion of the gate 271 is a sandwich construction that holds a rubber, semi-flexible blade or strip 279, in position aligned with the opening 260 as can be seen. The rubber blade 279 can be held on the gate 271 in any desired way, and has an edge portion 281 that protrudes down below the edge of the gate. The rubber blade is somewhat flexible, and yet will provide a braking friction for cards contacting it.

The position of the lower edge of the flexible blade 281 is controlled by a cam type shaft 283 that is rotatably mounted on the side wall 230 in a suitable manner, and spans over to a side wall 234, shown fragmentarily, where shaft 283 is also rotatably supported. The tongue or strap 275 extends upwardly above the shaft 283 and has a channel shaped holder 285 formed thereon, with a top wall 286, and a depending outer wall 288 (see FIG. 9). The depending outer wall 288 supports a movable cam follower plate 290 that is held with a small pivoting tab 292 to the wall 288, and this wall 290 rests upon a cam section 284 of the shaft 283. A spring shown at 294 is trapped between the wall 286 and the cam follower plate 290, and it is adjustable as to its compression force with a screw 296 in a conventional manner.

As shown in FIG. 9, the cam section 284 is made so that it has four different positions (the cam is a square cam) with the surfaces of the cam 294 at different distance from the center rotational axis of the shaft 283 so that at each of the four positions, the gate 270 would be adjusted to a different level. The shaft 183 has an actuator knob 200 accessible from the outside of the card feeder, so that the position of the gate or slider 170 can be changed manually by rotating the shaft 183 by using the knob 300.

It can be seen that a stepper motor or other controllable motor can be connected to drive shaft 183 or the shaft 50 in the first form of the invention The linear cam 168 can be driven by a motor and linear drive actuator as well.

The manual adjustment for the outlet opening of the hopper as shown permits quickly changing the outlet from a hopper to provide the proper vertical height dimension for reliably feeding cards for different thicknesses from the same hopper.

The vertical height between the lower edge of the flexible flap 181 in FIGS. 8 and 9 and the lower edge of the opening 160, which is the outlet opening for the cards from the card hopper, can be adjusted to suit the particular thickness of cards.

Figure 10:
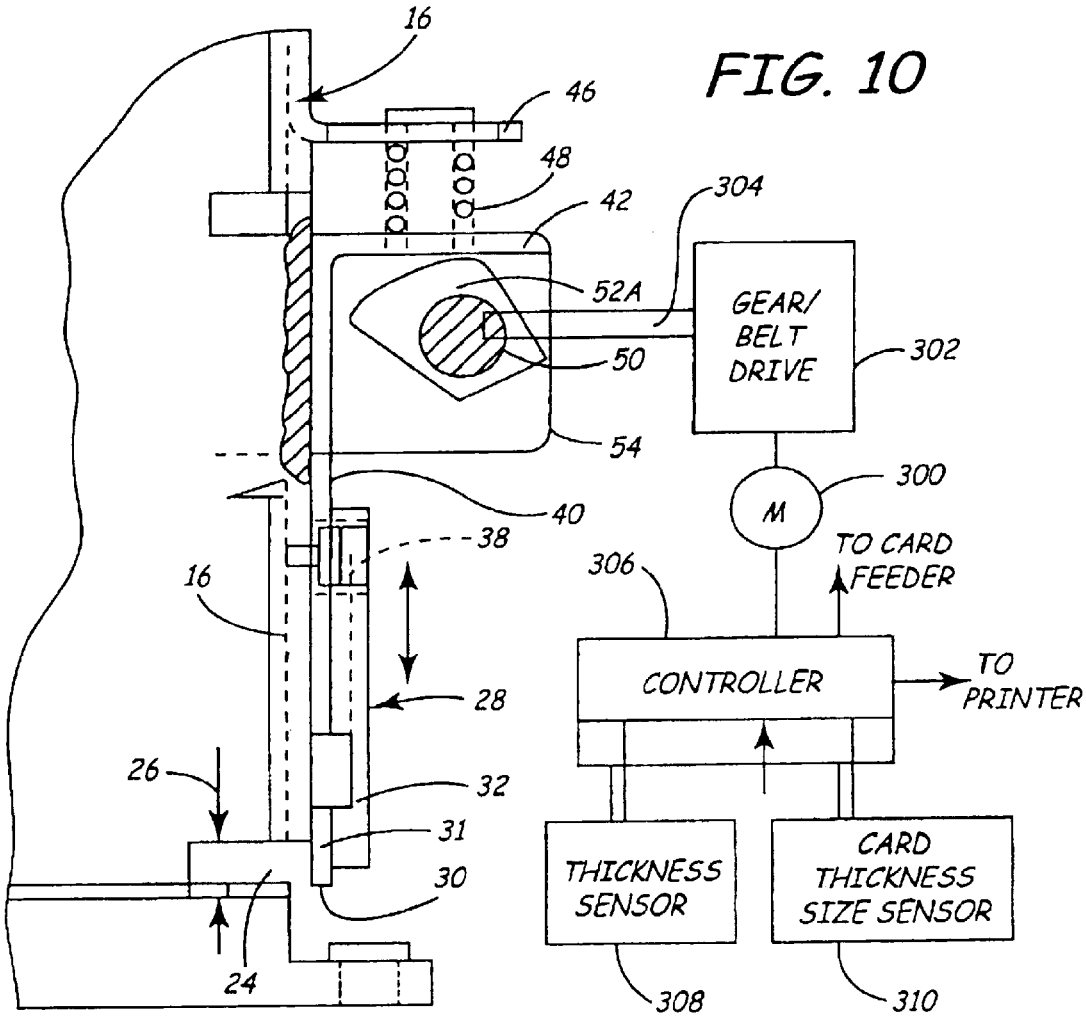
FIG. 10 is a schematic illustration of a motor drive for the cam operator used with the control gate.

FIG. 10 is a schematic representation of a motor drive used for driving the cam shaft for controlling the height of the control gate. The showing in FIG. 10 is the same as the embodiment shown in FIG. 4, and the numbers on the cam shaft, the controller, the gate, and other components are exactly the same as that shown in FIG. 4.

However, in this form of the invention, a stepper motor or reversible DC motor indicated generally at 300 is used for driving through either a gear or belt drive 302 and a drive link 304 to drive the cam shaft 50. The motor would be mounted on the end of the cam shaft where the control lever 56 presently is mounted, or in any other suitable location, and the motor, when driven, would either step or rotate the cam 52A a selected amount so that the control gate would be adjusted to a desired position, and the lower surface 30A would be spaced appropriately for a particular size of card.

A microprocessor controller 306 is used for controlling the motor 300, which again can be a stepper motor or reversible DC motor The controller 306 would have various inputs, including a program for the print process, and other inputs as necessary, to operate the printer and to drive the card feeder drive rollers.

Additionally, however, the controller could receive an input from a card thickness sensor 308 that would be used for giving an electrical or digital representation of card thickness, as selected. The thickness sensor could be an optical sensor, or other suitable sensors that would automatically measure the thickness of a card inserted into the sensor. The sensor could be built into the card hopper if desired.

Alternately, a manual card thickness/side selection input, indicated at 310 could be used. The thicknesses for a particular standard sized card could be preprogrammed in, and once the appropriate selector button for the size of the card was made, the thickness would be determined, and the motor 300 would be driven to move the cam shaft 50 and the cam 52A to the proper location for a card having that thickness. Additionally, individual settings could be made for each card thickness, or a full range of thicknesses could be used on a dial-up system.

In any event, once the input of the appropriate card thickness is made, the controller 306 would then drive the motor 300 in the proper direction and the proper amount to change the setting of the cam 52A and thus the lower edge 30 of the control gate to the appropriate height for feeding an individual card that is in the hopper.

The drive arrangement also can be used on any of the forms of the invention that are illustrated. If desired, the gear/belt drive could be operated on a rack and pinion arrangement for the horizontally sliding cam to achieve the same automatic operation for cards of individual thicknesses.

Although the present invention has been described with reference to preferred embodiments, workers skilled in the art will recognize that changes may be made in form and detail without departing from the spirit and scope of the invention.

What is claimed is:

1. A card feeder assembly including;

a hopper for storing a stack of cards to be fed;

a card drive for urging an end card of the stack from the hopper, said card drive being driven to move cards in a first direction and forming a support plane for the end card in the stack;

a wall of said hopper having a controllable size card outlet opening therethrough aligned with the end card in the stack of cards and through which only the end card of the stock is individually fed when driven by the card drive;

a control gate at said outlet opening slidably movable in a direction transverse to the first direction for adjusting a dimension of the opening transverse to the first direction as a function of a thickness of the cards in the stack; and an operator coupled to the control gate to control sliding movement of the control gate, the operator comprising a manually movable cam coupled to the control gate and slidably moving the control gate to change the position of the control gate when the manually movable cam is moved, to change and maintain the dimension of the outlet opening when cards of equal thickness are being fed.

2. The card feeder assembly of claim 1, wherein said cam comprises a rotatable cam, a cam follower on the control gate, said cam follower engaging said cam and shifting as the cam is rotated to change the dimension of the outlet opening.

3. The card feeder assembly of claim 2, wherein said rotatable cam is mounted on a cam shaft, a lever drivably mounted on said cam shaft and movable manually to rotate the cam to a desired position.

4. The card feeder assembly of claim 1, wherein said cam has a smoothly curved cam surface.

5. The card feeder assembly of claim 1, wherein said control gate comprises an actuator tab positioned at substantially right angles to the plane of movement of the control gate, the actuator tab forming a cam follower member, and the manually movable cam moving said cam follower member to control the position of the control gate.

6. The card feeder assembly of claim 5, wherein said cam comprises a rotary cam directly engaging the tab.

7. The card feeder assembly of claim 5, wherein said manually movable cam comprises a wedge shaped linearly cam, and said cam follower including a linearly moving member engaging the tab and sliding along the surface of said linearly movable cam.

8. The card feeder assembly of claim 1, and a stop member to hold the cam in a desired position.

9. The card feeder assembly of claim 8, wherein the cam is a linearly movable cam and said stop member comprises a screw tightenable down onto the linearly movable cam.

10. The card feeder assembly of claim 8, wherein the cam comprises a rotatable cam moved by a lever, and said stop member comprises a latch for stopping the movement of said lever.

11. The card feeder assembly of claim 1, and a manually operable member connected to said cam, and having a finger tab at an outer end thereof accessible adjacent to the hopper.

12. The card feeder assembly of claim 1, and a spring for urging the control gate in a first direction.

13. The card feeder assembly of claim 1, and a resilient strip on said control gate for defining one edge of the outlet opening of the wall.

14. A card feeder assembly including;

a hopper for storing a stack of cards to be fed;

a card drive for urging an end card of the stack from the hopper, said card drive being driven to move cards in a first direction and forming a support plane for the end card in the stack;

a wall of said hopper having a controllable size card outlet opening therethrough aligned with the end card in the stack of cards and through which only the end card of the stack is individually fed when driven by the card drive;

a control gate at said outlet opening slidably movable in a direction transverse to the first direction for adjusting a dimension of the opening transverse to the first direction as a function of a thickness of the cards in the stack; and an operator coupled to the control gate to control sliding movement of the control gate, the operator comprising a motor drive connected to the control gate, and a controller for controlling the motor drive to adjust the dimension of the outlet opening as a function of an input signal related to the thickness of the cards in the stack.

15. The card feeder assembly of claim 1, and a motor drive for driving the cam operator in response to input signals indicating the thickness of the card.

16. The card feeder assembly of claim 15, and a controller for controlling the motor in response to input signals indicating the thickness of the card.

17. A feed hopper for a stack of individual uniformly sized substrates having a uniform thickness:

a substrate drive for driving one substrate from an end of the stack in the hopper;

an outlet opening from the hopper having a dimension parallel to the substrate thickness;

a control plate adjustably supported on the hopper and having an edge extending across the outlet opening to define one edge of the outlet opening and being movable so the one edge of the control gate changes the dimension of the outlet opening parallel to the thickness dimension of the substrate; and a cam operator coupled to the control plate to change and maintain positions of the control plate to adjust the dimension the outlet openings.

18. A feed hopper for a stack of individual uniformly sized substrates having a uniform thickness dimension, comprising:

a substrate drive for driving one substrate from an end of the stack in the hopper;

an outlet opening from the hopper having a dimension parallel to the substrate thickness;

a control plate adjustably supported on the hopper and having an edge extending across the outlet opening to define one edge of the outlet opening and being movable so the one edge of the control gate changes the dimension of the outlet opening parallel to the thickness dimension of the substrate;

an adjustment mechnaism comprising a motorized drive coupled to the control plate for driving the control plate, and a controller for operating the motorized drive to adjust the outlet opening in respones to an input indicating the thickness dimension of the substrate in the feed hopper.

19. A feed hopper for a stack of individual uniformly sized substrates having a thickness:

a substrate drive for driving one substrate from an end of the stack in the hopper;

an outlet opening from the hopper having a dimension parallel to the substrate thickness;

a control plate slidably mounted on the hopper and having an edge extending across the outlet opening to define one edge of the outlet opening and being movable so the one edge of the control plate changes the dimension of the outlet opening parallel to the thickness dimension of the substrate;

a rotatable cam for changing the position of the control plate to adjust the dimension of the outlet opening; and a cam follower on the control plate, said cam follower engaging said cam and shifting the control plate as the cam is rotated to change the dimension of the outlet opening.

20. The feed hopper of claim 19, wherein said rotatable cam is mounted on a cam shaft, an actuator drivably mounted on said cam shaft for rotating the cam to a desired position.

21. The feed hopper of claim 20, wherein said actuator comprises a manually movable lever.

* * * * *

UNITED STATES PATENT AND TRADEMARK OFFICE

CERTIFICATE OF CORRECTION

PATENT NO. : 6,758,470 B1
DATED : July 6, 2004
INVENTOR(S) : James R. Meier et al.

It is certified that error appears in the above-identified patent and that said Letters Patent is hereby corrected as shown below:

Column 1,
Line 8, after "PRINTER," insert -- now U.S. PAT. No. 6,315,283 B1 --.

Column 7,
Line 64, "stock" should be -- stack --.

Column 10,
Line 11, "respones" should be -- response --.

Signed and Sealed this

Fourth Day of January, 2005

JON W. DUDAS
*Director of the United States Patent and Trademark Office*